US011417259B2

(12) United States Patent
Yang et al.

(10) Patent No.: US 11,417,259 B2
(45) Date of Patent: Aug. 16, 2022

(54) DRIVING METHOD OF DISPLAY DEVICE AND DRIVING DEVICE

(71) Applicants: WUHAN TIANMA MICRO-ELECTRONICS CO., LTD, Wuhan (CN); WUHAN TIANMA MICROELECTRONICS CO., LTD. SHANGHAI BRANCH, Shanghai (CN)

(72) Inventors: Shuai Yang, Shanghai (CN); Xingyao Zhou, Shanghai (CN); Yue Li, Shanghai (CN); Mengmeng Zhang, Shanghai (CN)

(73) Assignees: WUHAN TIANMA MICRO-ELECTRONICS CO., LTD., Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 0 days.

(21) Appl. No.: 17/229,876

(22) Filed: Apr. 14, 2021

(65) Prior Publication Data

US 2021/0233451 A1 Jul. 29, 2021

(30) Foreign Application Priority Data

Dec. 24, 2020 (CN) ..... 202011552525.8

(51) Int. Cl.
*G09G 3/20* (2006.01)
*G09G 3/3233* (2016.01)

(52) U.S. Cl.
CPC ..... *G09G 3/20* (2013.01); *G09G 3/3233* (2013.01); *G09G 2300/0819* (2013.01);
(Continued)

(58) Field of Classification Search
None
See application file for complete search history.

(56) References Cited

U.S. PATENT DOCUMENTS 5,991,883 A * 11/1999 Atkinson ..... G06F 1/3203 715/201
2003/0020699 A1* 1/2003 Nakatani ..... G09G 3/3611 345/204

(Continued)

FOREIGN PATENT DOCUMENTS

CN 102957922 A 3/2013
CN 111739916 A 10/2020

*Primary Examiner* — Dorothy Harris
(74) *Attorney, Agent, or Firm* — Kilpatrick Townsend & Stockton LLP

(57) ABSTRACT

Disclosed are a driving method of a display device and a driving device is described. The driving method of a display panel includes that in response to determining that the display device enters a low power consumption state, controlling a light intensity detection component to detect in real time whether the display device is in a strong light environment; in a case where the display device is in the strong light environment, controlling a driver chip to adjust a picture refresh frequency to a first frequency; in a case where the display device is not in the strong light environment, determining a current gray scale of the display device according to a latest user setting instruction, determining an optimal refresh frequency according to the current gray scale and a corresponding relationship between a preset gray scale and the optimal refresh frequency.

17 Claims, 5 Drawing Sheets

(52) U.S. Cl.
CPC . *G09G 2300/0842* (2013.01); *G09G 2310/08* (2013.01); *G09G 2330/021* (2013.01); *G09G 2340/0435* (2013.01); *G09G 2354/00* (2013.01); *G09G 2360/14* (2013.01); *G09G 2360/144* (2013.01)

(56) References Cited

U.S. PATENT DOCUMENTS

| | | | | |
|---|---|---|---|---|
| 2015/0194137 | A1* | 7/2015 | Wyatt | G09G 5/393 345/173 |
| 2017/0365461 | A1* | 12/2017 | Iwaki | G06F 7/575 |
| 2018/0197499 | A1* | 7/2018 | Wang | G09G 5/003 |

* cited by examiner

DRIVING METHOD OF DISPLAY DEVICE AND DRIVING DEVICE

CROSS-REFERENCE TO RELATED APPLICATION

This application claims priority to Chinese Patent Application No. 202011552525.8 filed Dec. 24, 2020, the disclosure of which is incorporated herein by reference in its entirety.

FIELD

Embodiments of the present disclosure relate to the field of display and, in particular, to a driving method of a display device and a driving device.

BACKGROUND

A standby mode of a display device has an advantage of low power consumption and is therefore also referred to as a low power consumption state.

In the related art, a display device includes multiple driver circuits and multiple light-emitting elements, the multiple driving circuits are electrically connected in one-to-one correspondence to the multiple light-emitting elements, and the light-emitting elements emit light under driving of the corresponding driving circuits. A driver circuit includes multiple thin film transistors. Affected by the manufacturing process, a thin film transistor cannot be completely turned off in a turned-off state, that is, a leakage current exits. After the display device enters the low power consumption state, the picture refresh frequency of the display device is reduced compared with in a normal display state, so that the switching speed of the thin film transistor is slowed down, the duration of the continuous leakage is increased, the leakage current is increased, and thus the phenomenon of picture shaking becomes apparent. Particularly in a strong light environment, the leakage current of the thin film transistor is increased significantly under the action of light, so that the shaking phenomenon is further intensified.

SUMMARY

The disclosure provides a driving method of a display panel and a driving device to alleviate the phenomenon of picture shaking in a low power consumption state.

In one embodiments of the present disclosure provide a driving method of a display device. The driving method includes the steps described below.

In response to determining that the display device enters a low power consumption state, a light intensity detection component is controlled to detect in real time whether the display device is in a strong light environment.

In a case where the display device is in the strong light environment, a driver chip is controlled to adjust a picture refresh frequency to a first frequency.

In a case where the display device is not in the strong light environment, a current gray scale of the display device is determined according to a latest user setting instruction, an optimal refresh frequency is determined according to the current gray scale and a corresponding relationship between a preset gray scale and the optimal refresh frequency, and the driver chip is controlled to adjust the picture refresh frequency to the optimal refresh frequency.5

The first frequency and the optimal refresh frequency each are smaller than a picture refresh frequency of the display device in a normal display state.

In another the embodiments of the present disclosure further provide a driving device of a display device. The driving device includes a strong light detection device, a first frequency adjustment device and a second frequency adjustment device.

The strong light detection device is configured to: in response to determining that the display device enters a low power consumption state, control a light intensity detection component to detect in real time whether the display device is in a strong light environment.

The first frequency adjustment device is configured to: in response to the light intensity detection component determining that the display device is in the strong light environment, control a driver chip to adjust a picture refresh frequency to a first frequency.

The second frequency adjustment device is configured to: in response to the light intensity detection component determining that the display device is in a non-strong light environment, determine a current gray scale of the display device according to a latest user setting instruction, determine an optimal refresh frequency according to the current gray scale and a corresponding relationship between a preset gray scale and the optimal refresh frequency, and control the driver chip to adjust the picture refresh frequency to the optimal refresh frequency.

The first frequency and the optimal refresh frequency each are smaller than a picture refresh frequency of the display device in a normal display state.

According to the schemes provided by the embodiments of the present disclosure, in response to determining that the display device enters a low power consumption state, a light intensity detection component is controlled to detect in real time whether the display device is in a strong light environment; in a case where the display device is in the strong light environment, a driver chip is controlled to adjust a picture refresh frequency to a first frequency; in a case where the display device is not in the strong light environment, a current gray scale of the display device is determined according to a latest user setting instruction, an optimal refresh frequency is determined according to the current gray scale and a corresponding relationship between a preset gray scale and the optimal refresh frequency, and the driver chip is controlled to adjust the picture refresh frequency to the optimal refresh frequency; where the first frequency and the optimal refresh frequency each are smaller than a picture refresh frequency of the display device in a normal display state. Therefore, in the low consumption state, picture shaking is reduced by adjusting the picture refresh frequency.

BRIEF DESCRIPTION OF DRAWINGS

Embodiments of the present disclosure will become more apparent from a detailed description of non-restrictive embodiments with reference to the drawings.

DETAILED DESCRIPTION

Figure 1:
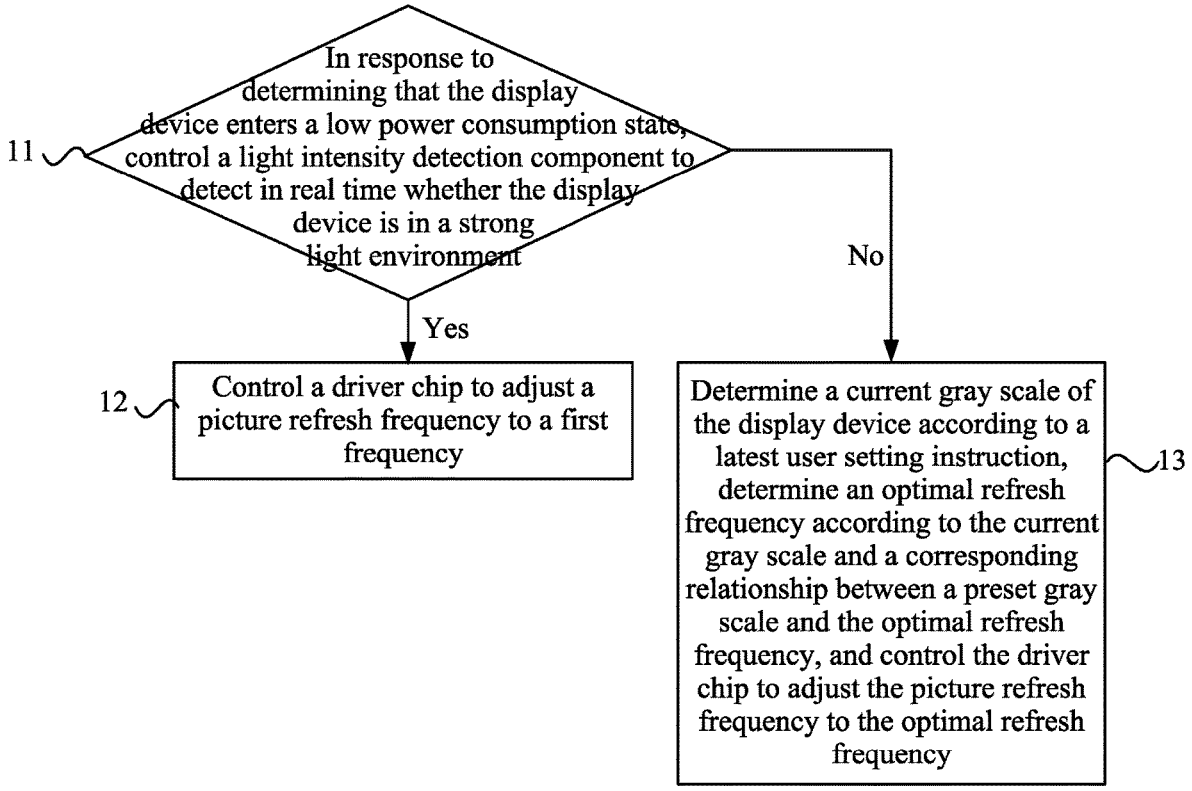
FIG. 1 is a flowchart of a driving method of a display device according to an embodiment of the present disclosure.

To further elaborate on the means for achieving an intended purpose of the present disclosure and effects, embodiments, structures, features and effects of a driving method of a display device and a driving device provided by the present disclosure are described hereinafter in detail with reference to drawings and embodiments.

The embodiments of the present disclosure provide a driving method of a display device. The method includes the steps described below.

In response to determining that the display device enters a low power consumption state, a light intensity detection component is controlled to detect in real time whether the display device is in a strong light environment.

In a case where the display device is in the strong light environment, a driver chip is controlled to adjust a picture refresh frequency to a first frequency.

In a case where the display device is not in the strong light environment, a current gray scale of the display device is determined according to a latest user setting instruction, an optimal refresh frequency is determined according to the current gray scale and a corresponding relationship between a preset gray scale and the optimal refresh frequency, and the driver chip is controlled to adjust the picture refresh frequency to the optimal refresh frequency.

The first frequency and the optimal refresh frequency each are smaller than a picture refresh frequency of the display device in a normal display state.

According to the schemes provided by the embodiments of the present disclosure, in response to determining that the display device enters a low power consumption state, a light intensity detection component is controlled to detect in real time whether the display device is in a strong light environment; in a case where the display device is in the strong light environment, a driver chip is controlled to adjust a picture refresh frequency to a first frequency; in a case where the display device is not in the strong light environment, a current gray scale of the display device is determined according to a latest user setting instruction, an optimal refresh frequency is determined according to the current gray scale and a corresponding relationship between a preset gray scale and the optimal refresh frequency, and the driver chip is controlled to adjust the picture refresh frequency to the optimal refresh frequency; where the first frequency and the optimal refresh frequency each are smaller than a picture refresh frequency of the display device in a normal display state. Therefore, in the low consumption state, picture shaking is reduced by adjusting the picture refresh frequency.

Hereinafter, schemes in the embodiments of the present disclosure will be described clearly and completely in conjunction with the drawings in the embodiments of the present disclosure. Apparently, the embodiments described below are part, not all, of the embodiments of the present disclosure.

Details are set forth below to facilitate a thorough understanding of the present disclosure. However, the present disclosure may be implemented by other implementations different from the embodiments described herein, and similar generalizations can be made without departing from the spirit of the present disclosure. Therefore, the disclosure is not limited to the specific embodiments described below.

In addition, the present disclosure will be described in detail in conjunction with the drawings. In detailed description of the embodiments of the present disclosure, for ease of description, schematic diagrams illustrating structures of devices and components are not partially enlarged in accordance with a general proportional scale. The schematic diagrams are merely illustrative and are not intended to limit the scope of the present disclosure. In addition, actual manufacturing includes three-dimension spatial sizes: length, width and height.

FIG. 1 is a flowchart of a driving method of a display device according to an embodiment of the present disclosure. The driving method of a display panel is applicable to the driving process of a display device in a low consumption state. As shown in FIG. 1, the driving method of a display device may specifically include the steps described below.

In step 11, in response to determining that the display device enters a low power consumption state, a light intensity detection component is controlled to detect in real time whether the display device is in a strong light environment.

The low power consumption state is a standby state of the display device, that is, a state in which the display device is turned on but does not perform any substantial operating (that is, does not perform various operations on files and programs). Exemplarily, the step of determining that the display device enters the low power consumption state may include: in response to an accumulated no-process state lasting for a preset duration, it is determined that the display device enters the low power consumption state. The preset duration is a fixed duration preset by a user, for example, 2 s. In this way, the display device can automatically enter the low power consumption state when the accumulated no-process state lasts for the preset duration without a user operation, which is beneficial to simplify the user operation. In addition, if a central processing unit immediately enters the low power consumption state when it is determined that the central processing unit enters the non-process state, it is caused that the low power consumption state is frequently entered during the discontinuous operation of the user, so that user's current operation is interrupted, and the power consumption of the display device is increased.

The specific structure of the light intensity detection component is not limited in the embodiment, and the structure of the light intensity detection component that detects whether the environment light is strong or not is within the scope of the embodiment. It is to be understood that the light intensity detection component may detect the parameter of the environment light directly or indirectly through other parameters such as a current.

It should be noted that the strong light is the major cause of severe picture shaking in the low power consumption state. Therefore, after the low power state is entered, it is necessary to first determine whether the display device is in the strong light environment.

In step 12, in a case where the display device is in the strong light environment, a driver chip is controlled to adjust a picture refresh frequency to a first frequency.

It should be noted that when the picture refresh frequency is the first frequency, the switching frequency of a drive transistor in a driver circuit of the display device is moderate, the duration of the continuous leakage of a thin film transistor is moderate, so that the leakage current of the thin film transistor is insufficient to cause a significant phenomenon of picture shaking. Exemplarily, the range of the first frequency, for example, may be 20 Hz to 30 Hz.

Figure 2:
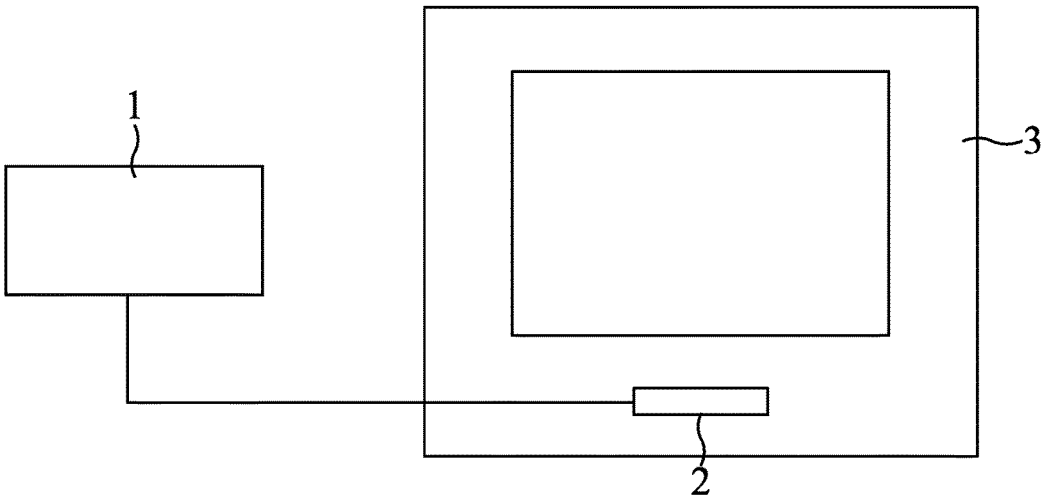
FIG. 2 is a structural diagram of a display device according to an embodiment of the present disclosure.

FIG. 2 is a structural diagram of a display device according to an embodiment of the present disclosure. As shown in FIG. 2, the display device includes the central processing unit 1, the driver chip 2 and a display panel 3. The central processing unit 1 is the control center and the operation center of the display device, and the driver chip 2 drives the display panel 3 to display a picture under the control of the central processing unit 1. It can be seen that the picture refresh frequency is directly controlled by the driver chip 2. After determining that the display device enters the low power consumption state, the central processing unit 1 controls the driver chip 2 to adjust the screen refresh frequency to the first frequency, and the adjustment mode is a conventional means and is not described in detail herein.

In step 13, in a case where the display device is not in the strong light environment, a current gray scale of the display device is determined according to a latest user setting instruction, an optimal refresh frequency is determined according to the current gray scale and a corresponding relationship between a preset gray scale and the optimal refresh frequency, and the driver chip is controlled to adjust the picture refresh frequency to the optimal refresh frequency.

It should be noted that the user may change the current gray scale of the display device through patterned control modes such as a virtual slide bar on the display picture. It is to be understood that the current gray scale is the overall gray scale of the display picture. Specifically, the display panel recognizes the user's specific slide operation, and generates a user setting instruction and sends the user setting instruction to the central processing unit. Based on the user setting instruction, the central processing unit controls the driver chip to adjust the gray scale of the display device to the gray scale set by the user. It is to be understood that the latest user setting instruction refers to the last user setting instruction generated at the current moment, and the gray scale displayed by the display device according to the user setting instruction is the current gray scale.

Figure 3:
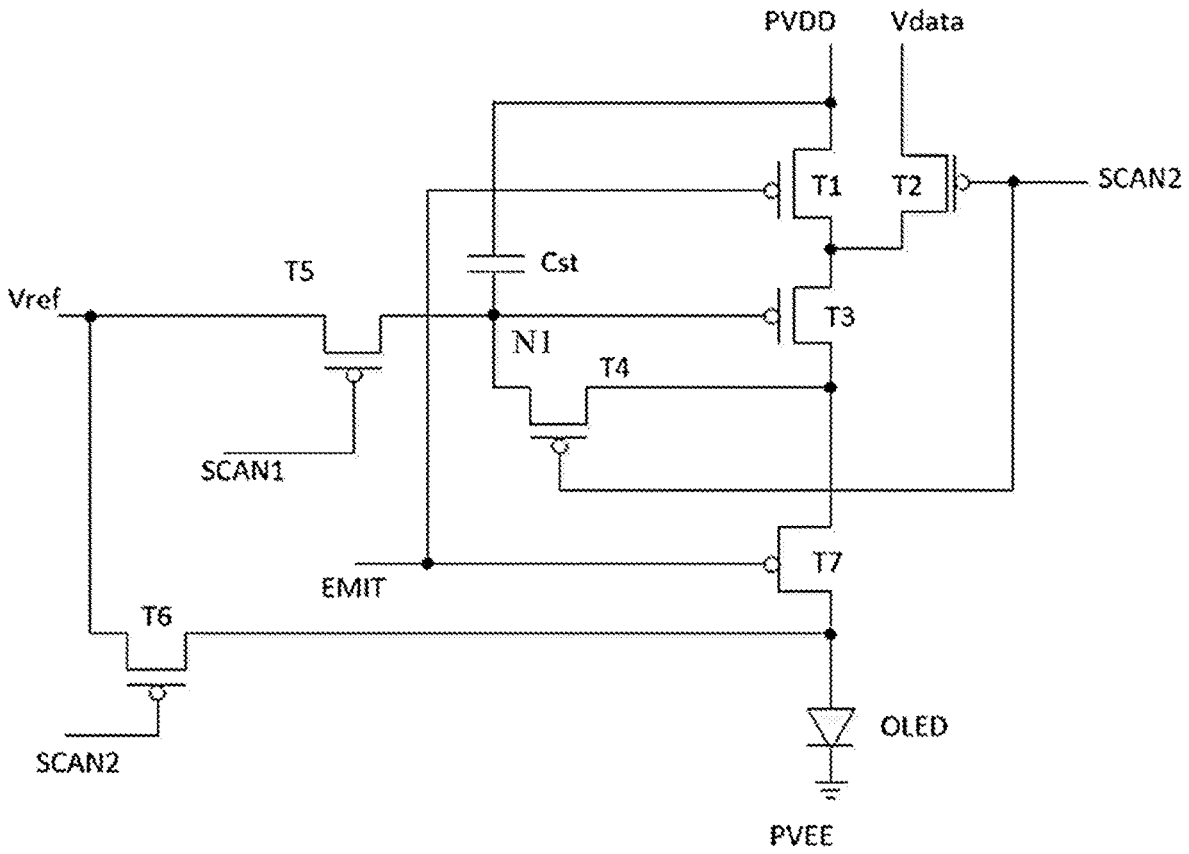
FIG. 3 is a structural diagram of a pixel driver circuit according to an embodiment of the present disclosure.

FIG. 3 is a structural diagram of a pixel driver circuit according to an embodiment of the present disclosure. As shown in FIG. 3, the pixel driver circuit is of a 7T1C structure, that is, includes seven thin film transistors and a storage capacitor. A first thin film transistor T3 is a drive transistor. The phenomenon of picture shaking is minimized when a gate leakage current, a source leakage current and a drain leakage current of the drive transistor T3 reach a balance state. The gate leakage current is related to the potential of an N1 node, and the potential of the N1 node is determined by a data signal Vdata in a data write stage, so that the potential of the N1 node is related to the data signal Vdata, and the data signal Vdata determines the current gray scale of the display device. When the current gray scale is determined, the data signal Vdata is determined, the potential of the N1 node is determined and the gate leakage current of the drive transistor T3 is determined, the gate leakage current, the source leakage current and the drain leakage current of the drive transistor T3 may reach a balance state by adjusting the picture refresh frequency, and the adjusted picture refresh frequencies corresponding to different gate leakage currents are different. It can be seen that the picture refresh frequencies corresponding to different current gray scales for achieving the minimum shaking state of the picture are different, and a one-to-one correspondence between the current gray scales and the picture refresh frequencies. Exemplarily, the corresponding relationship may be pre-stored in the central processing unit in the form of, for example, a table, or, if the picture refresh frequencies corresponding to the gray scales in a range are similar, the corresponding relationship between the gray scales in the range and the specific picture refresh frequencies may be pre-stored in the central processing unit in a table form, and the corresponding relationship between the gray scales and the picture refresh frequencies in the table is the pre-stored corresponding relationship between the current gray scale and the optimal refresh frequency. After the current gray scale is determined, the corresponding optimal refresh frequency may be directly obtained by looking up the table, and the driver chip is controlled to adjust the picture refresh frequency of the display device to the optimal refresh frequency, so that picture shaking of the display device is relatively small under the current gray scale.

It should be further noted that the effect of the strong light on the leakage of a thin film transistor is much greater than the manufacturing process of the thin film transistor itself on the leakage of the thin film transistor. Therefore, in a non-strong light environment, the picture refresh frequency required for the gate leakage current, the source leakage current and the drain leakage current of the drive transistor to reach the balance state is relatively small, while the picture refresh frequency required for alleviating picture shaking caused by the increase of the leakage current due to the strong light is relatively large, and thus the first refresh frequency is generally greater than the optimal refresh frequency. Since the current state is the low power consumption state, the picture refresh frequencies of the first refresh frequency and the optimal refresh frequency are both smaller than the picture refresh frequency in a normal display state.

According to the schemes provided by the embodiment, in response to determining that the display device enters the low power consumption state, the light intensity detection component is controlled to detect in real time whether the display device is in the strong light environment; in a case where the display device is in the strong light environment, the driver chip is controlled to adjust the picture refresh frequency to the first frequency; in a case where the display device is not in the strong light environment, the current gray scale of the display device is determined according to the latest user setting instruction, the optimal refresh frequency is determined according to the current gray scale and the corresponding relationship between the preset gray scale and the optimal refresh frequency, and the driver chip is controlled to adjust the picture refresh frequency to the optimal refresh frequency; where the first frequency and the optimal refresh frequency each are smaller than the picture refresh frequency of the display device in the normal display state. Therefore, in the low consumption state, picture shaking is reduced by adjusting the picture refresh frequency.

Exemplarily, the light intensity detection component may be an environment light sensor.

The environment light sensor may be composed of, for example, photosensitive elements and may directly detect the luminance of the environment light. For the environment light sensor, the structure is simple, the cost is low, and the detection is easy to achieve.

Figure 4:
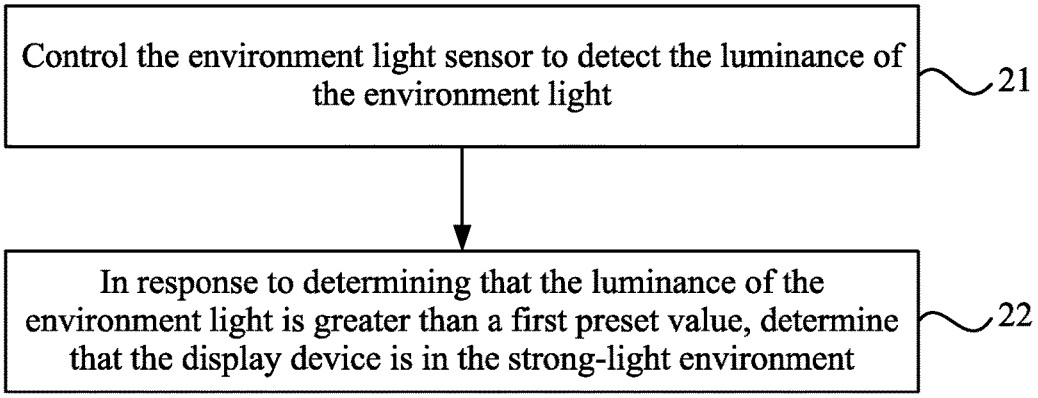
FIG. 4 is a flowchart of a method of controlling a light intensity detection component to detect in real time whether the display device is in a strong light environment according to an embodiment of the present disclosure.

Correspondingly, FIG. 4 is a flowchart of a method of controlling a light intensity detection component to detect in real time whether the display device is in a strong light environment according to an embodiment of the present disclosure. As shown in FIG. 4, the step of controlling the light intensity detection component to detect in real time whether the display device is in the strong light environment may specifically include the steps described below.

In step 21, the environment light sensor is controlled to detect the luminance of the environment light.

Specifically, the central processing unit controls the environment light sensor to detect the luminance of the environment light, the environment light sensor transmits the detected luminance information to the central processing unit, and the central processing unit specifically determines whether the environment light is strong light.

In step 22, in response to determining that the luminance of the environment light is greater than a first preset value, it is determined that the display device is in the strong-light environment.

It is to be noted that the luminance of the light in the strong light environment is relatively great, and for example, the light whose luminance is greater than the first preset value is considered as the luminance of the light in the strong light environment. When determining that the luminance of the light detected by the environment light sensor is greater than the first preset value, the central processing unit determines that the display device is in the strong light environment.

Exemplarily, the first preset value may be 300 cd/m2.

It should be noted that experiments have proven that the light whose luminance is greater than 300 cd/m2 may significantly increase the leakage current of the thin film transistor in the pixel driver circuit in the display device, and has a relatively large impact on picture shaking. Therefore, the first preset value is set to be 300 cd/m2 so that the phenomenon of picture shaking can be effectively alleviated by adjusting the picture refresh frequency.

In an embodiment, the light intensity detection component may be a current detection circuit.

It should be noted that the specific structure of the circuit detection circuit is not limited by the embodiment, and all circuit structures to achieve current detection are within the scope of the embodiment, such as a current detection chip.

It should be further noted that illumination causes the leakage current of the thin film transistor to increase, and that a positive correlation exits between the luminance of the light and the leakage current, and whether the display device is in the strong light environment may be determined by testing the related current.

Figure 5:
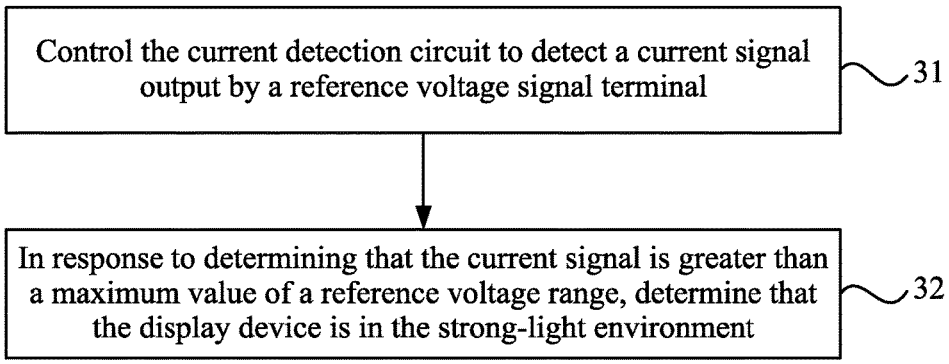
FIG. 5 is a flowchart of another method of controlling a light intensity detection component to detect in real time whether the display device is in a strong light environment according to an embodiment of the present disclosure.

Correspondingly, FIG. 5 is a flowchart of another method of controlling a light intensity detection component to detect in real time whether the display device is in a strong light environment according to an embodiment of the present disclosure. As shown in FIG. 5, the specific flowchart of the step of controlling the light intensity detection component to detect in real time whether the display device is in the strong light environment may include the steps described below.

In step 31, the current detection circuit is controlled to detect a current signal output by a reference voltage signal terminal. The reference voltage signal terminal is connected to the gate of the drive transistor of the pixel driver circuit in the display device.

It should be noted that with continued reference to FIG. 3, a Vref signal terminal is the reference voltage signal terminal, which is configured for outputting a Vref signal to the N1 node. The N1 node is connected to the gate of the drive transistor. When the display device is in the strong light environment, the gate leakage current of the drive transistor is increased, so that the current of the Vref signal terminal is increased, the corresponding light intensity may be determined by testing the current signal of the Vref terminal, and whether the display device is in the strong light environment is further determined.

It should be further noted that the source leakage current and the drain leakage current of the drive transistor also increase significantly under the impact of the strong light, but to a lesser extent than the gate leakage current, and in the conventional 7T1C pixel driver circuit, the Vref signal terminal is provided with a current detection terminal to facilitate the detection of the current of the Vref signal terminal.

In step 32, in response to determining that the current signal is greater than a maximum value of a reference voltage range, it is determined that the display device is in the strong-light environment.

The reference voltage range is pre-stored in the central processing unit. Specifically, the reference voltage signals under different gray scales in the non-strong environment is pre-tested, and the minimum voltage range including the reference voltage signals obtained through the test is taken as the reference voltage range. Exemplarily, the reference voltage range may be 200 μA to 400 μA. Correspondingly, when it is determined that the current signal is greater than 400 μA, it is determined that the display device is in the strong light environment.

It should be noted that according to different structures of the pixel driver circuit in the display device and different transistor manufacturing processes, the reference voltage ranges obtained through the test are different and are not limited to 200 μA to 400 μA provided by the embodiment, and may be reasonably set according to actual situations.

In an embodiment, the corresponding relationship between the preset gray scale and the optimal refresh frequency may specifically include: an optimal refresh frequency corresponding to 0 gray scale is a second frequency; an optimal refresh frequency corresponding to (128−a) gray scale to (128+b) gray scale is a third frequency; and an optimal refresh frequency corresponding to 1 gray scale to (127−a) gray scale and an optimal refresh frequency corresponding to (129+b) gray scale to 255 gray scale each are a fourth frequency, a and b each are positive integers, $1 \leq a \leq 63$, and $1 \leq b \leq 125$.

It should be noted that in general, a one-to-one correspondence exits between the gray scale and the picture refresh frequency in the case of minimum picture shaking, but when the operation frequency of switching the gray scale of the display device by the user is high, the driver chip needs to switch the picture refresh frequency frequently, so that the power consumption in the low power consumption state is increased. Based on the above consideration, it is set that 0 gray scale to 255 gray scale correspond to only three optimal picture refresh frequencies, so that the increase of the power consumption of the display device when the frequency of the gray scale changing is high is avoided while picture shaking is reduced.

It should be further noted that the low power consumption state includes a black picture state and a picture display state. In the black picture state, the current gray scale of the display device is 0 gray scale; in the picture display state, for example, in a display state of a time display interface, the current gray scale of the display device is a non-0 gray scale, which is specifically determined according to the gray scale setting operation of the user. In the black picture state, picture shaking will not be directly observed by human eyes, so that the phenomenon of picture shaking does not need to be alleviated by increasing the picture refresh frequency, and only the low power consumption state is needed to be considered. Based on the above analysis, in the black picture state, the picture refresh frequency of the display device is set to be a relatively low refresh frequency, so that the power consumption is effectively reduced.

For 1 gray scale to 255 gray scale, the test results show that the picture refresh frequencies corresponding to (128−a) gray scale to (128+b) gray scale to achieve the minimum picture shaking are less different, and the picture refresh frequencies corresponding to 1 gray scale to (127−a) gray scale and (129+b) gray scale to 255 gray scale to achieve the minimum picture shaking are less different. In order to reduce the frequency of adjusting the picture refresh frequency, the optimal refresh frequencies corresponding to (128−a) gray scale to (128+b) gray scale are set to be the same, and the optimal refresh frequencies corresponding to 1 gray scale to (127−a) gray scale and (129+b) gray scale to 255 gray scale are set to be the same.

Exemplarily, the second frequency may be 1 Hz, the third frequency may be 15 Hz, and the fourth frequency may be 20 Hz.

In an embodiment, a power signal may be turned off while the driver chip is controlled to adjust the picture refresh frequency to the second frequency.

The power signal includes a positive power signal and a negative power signal. Referring to FIG. 3, the positive power signal is a PVDD signal, and the negative power signal is a PVEE signal. Specifically, the PVDD signal and the PVEE signal are both provided by a power chip.

It should be noted that when the driver chip is controlled to adjust the picture refresh frequency to the second frequency, the display device enters a 0 gray scale state, that is, a black picture state, no specific picture is displayed, and whether a power signal exits in the pixel driver circuit has no impact on the picture display. Therefore, at this time, if the power signal is turned off, the power consumption in the low power consumption state can be further reduced while the picture display is not influenced.

Figure 6:
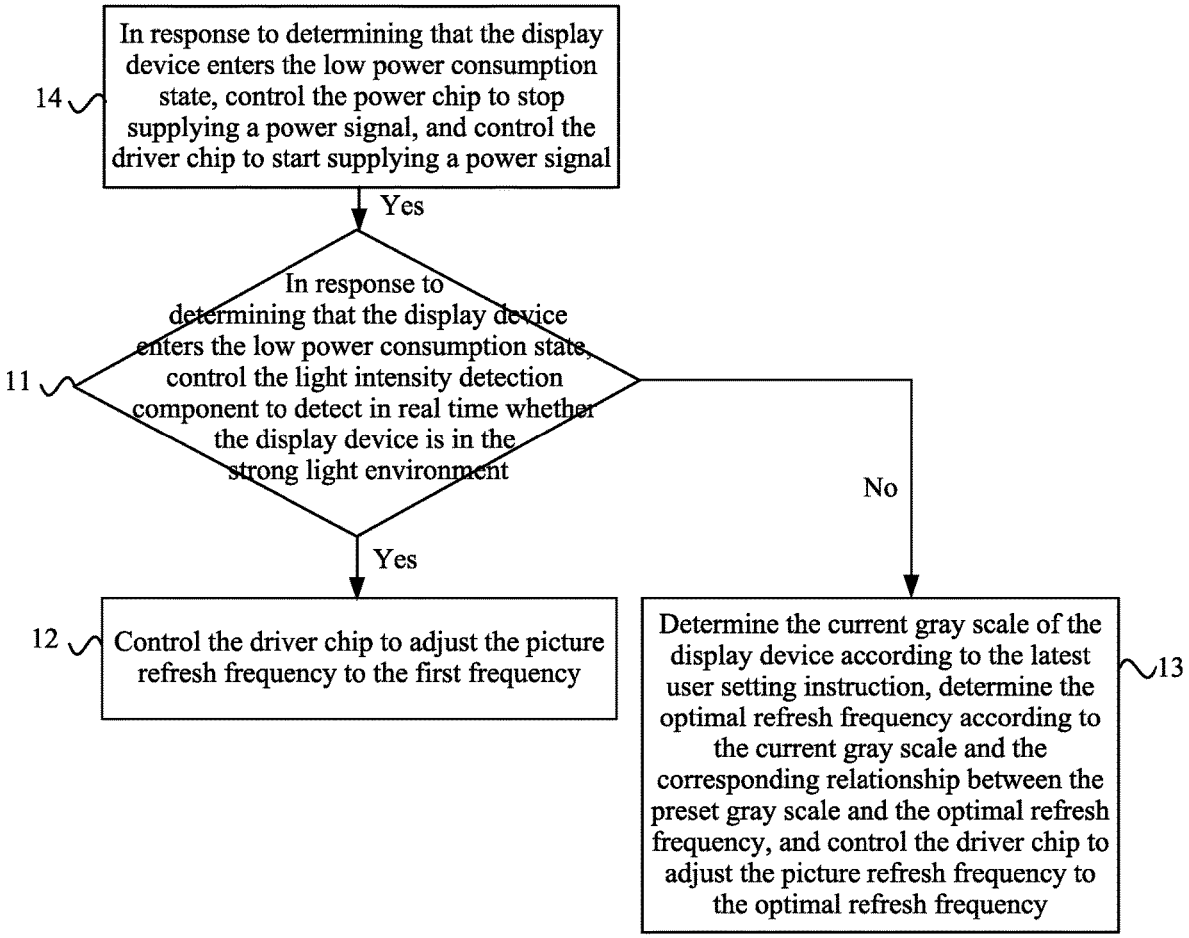
FIG. 6 is a flowchart of another driving method of a display device according to an embodiment of the present disclosure.

FIG. 6 is a flowchart of another driving method of a display device according to an embodiment of the present disclosure. As shown in FIG. 6, on the basis of FIG. 1, the driving method of a display device shown in FIG. 6 further includes the step described below.

In step 14, in response to determining that the display device enters the low power consumption state, the power chip is controlled to stop supplying a power signal, and the driver chip is controlled to start supplying a power signal.

It should be noted that the power signal is still required in the low power consumption state, but the required power signal is smaller than the power signal in the normal display state. In order to reduce the power consumption of the display device more effectively, the power chip which only needs to provide a relatively small power signal stops operating after the low power consumption state is entered, and the driver chip which still needs to perform picture refresh frequency adjustment supplies power at the same time, so that the number of chips in the operating state is reduced, and the power consumption of the display device is reduced.

Figure 7:
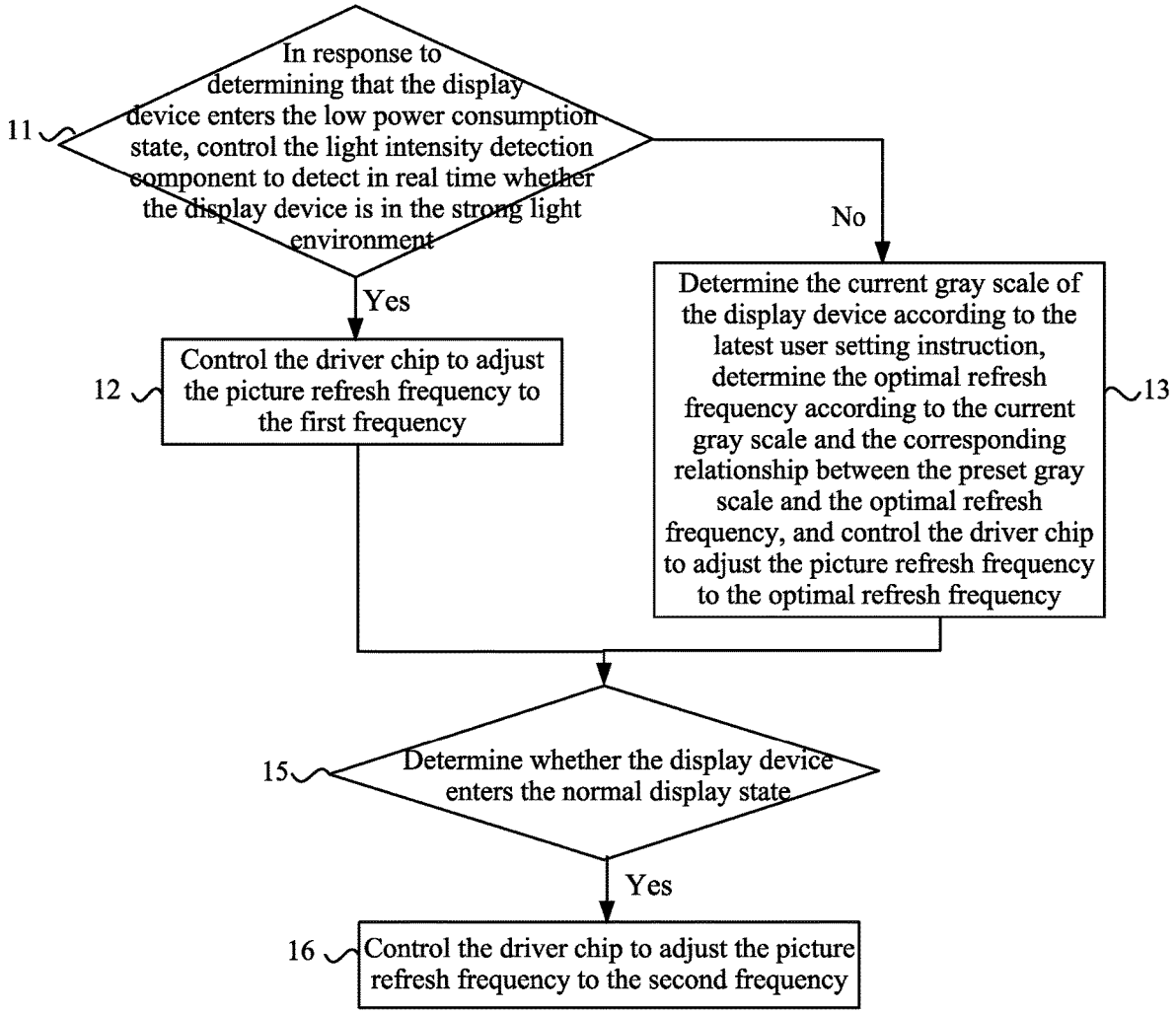
FIG. 7 is a flowchart of another driving method of a display device according to an embodiment of the present disclosure.

FIG. 7 is a flowchart of another driving method of a display device according to an embodiment of the present disclosure. As shown in FIG. 7, on the basis of FIG. 1, the driving method of a display panel shown in FIG. 7, after the driver chip is controlled to adjust the picture refresh frequency to the first frequency or the driver chip is controlled to adjust the picture refresh frequency to the optimal refresh frequency, further includes the steps described below.

In step 15, whether the display device enters the normal display state is determined.

The normal display state is an operating state of a non-low power consumption state of the display device, the picture display is normally performed, and the refresh frequency of the picture needs to be high to ensure that the picture is displayed smooth.

It should be noted that the method of determining whether the normal display state is entered includes the following step: when detecting that a new process is started, the central processing unit determines that the normal display state is entered.

In step 16, in a case where the normal display state is entered, the driver chip is controlled to adjust the picture refresh frequency to the second frequency. The second frequency is the picture refresh frequency of the display device in the normal display state.

Specifically, after determining that the display device enters the normal display state, the central processing unit controls the driver chip to adjust the picture refresh frequency to the second frequency. A normal refresh frequency is, for example, 60 Hz, which is greater than the picture refresh frequency at any moment in the low power consumption state.

Figure 8:
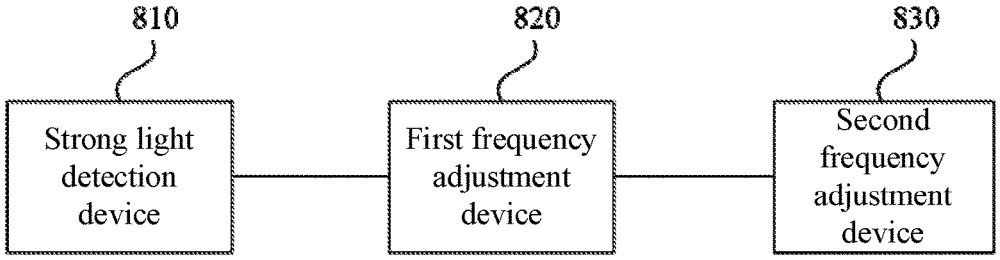
FIG. 8 is a structure diagram of a driving device of a display device according to an embodiment of the present disclosure.

FIG. 8 is a structure diagram of a driving device of a display device according to an embodiment of the present disclosure. As shown in FIG. 8, the driving device of a display device may specifically include a strong light detection device 810, a first frequency adjustment device 820 and a second frequency adjustment device 830.

The strong light detection device 810 is configured to: in response to determining that the display device enters the low power consumption state, control the light intensity detection component to detect in real time whether the display device is in the strong light environment.

The first frequency adjustment device 820 is configured to: in response to the light intensity detection component determining that the display device is in the strong light environment, control the driver chip to adjust the picture refresh frequency to the first frequency.

The second frequency adjustment device 830 is configured to: in response to the light intensity detection component determining that the display device is in the non-strong light environment, determine the current gray scale of the display device according to the latest user setting instruction, determine the optimal refresh frequency according to the current gray scale and the corresponding relationship between the preset gray scale and the optimal refresh frequency, and control the driver chip to adjust the picture refresh frequency to the optimal refresh frequency.

The first frequency and the optimal refresh frequency each are smaller than the picture refresh frequency of the display device in the normal display state.

The driving device of a display device provided by the embodiment includes the strong light detection device, the first frequency adjustment device and the second frequency adjustment device. The strong light detection device is configured to: in response to determining that the display device enters the low power consumption state, control the light intensity detection component to detect in real time whether the display device is in the strong light environment. The first frequency adjustment device 820 is configured to: in response to the light intensity detection component determining that the display device is in the strong light environment, control the driver chip to adjust the picture refresh frequency to the first frequency. The second frequency adjustment device is configured to: in response to the light intensity detection component determining that the display device is in the non-strong light environment, determine the current gray scale of the display device according to the latest user setting instruction, determine the optimal refresh frequency according to the current gray scale and the corresponding relationship between the preset gray scale and the optimal refresh frequency, and control the driver chip to adjust the picture refresh frequency to the optimal refresh frequency. The first frequency and the optimal refresh frequency each are smaller than the picture refresh frequency of the display device in the normal display state. Therefore, in the low consumption state, picture shaking is reduced by adjusting the picture refresh frequency.

In the embodiment, the light intensity detection component may be the environment light sensor.

Figure 9:
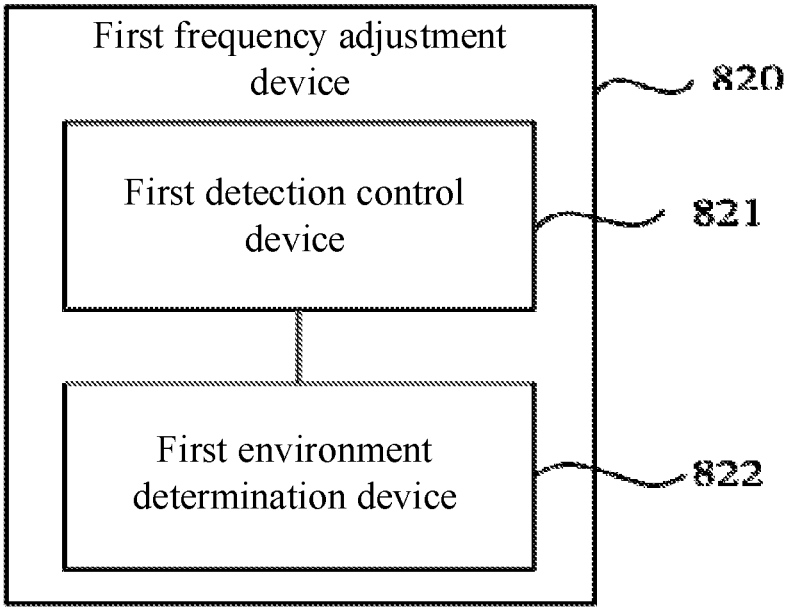
FIG. 9 is a structural diagram of a first frequency adjustment device according to an embodiment of the present disclosure.

Correspondingly, FIG. 9 is a structural diagram of a first frequency adjustment device according to an embodiment of the present disclosure. As shown in FIG. 9, the first frequency device 820 may include a first detection control device 821 and a first environment determination device 822.

The first detection control device 821 is configured to control the environment light sensor to detect the luminance of the environment light.

The first environment determination device 822 is configured to: in response to determining that the luminance of the environment light is greater than the first preset value, determine that the display device is in the strong light environment.

In other implementations of the embodiment, the light intensity detection component may be the current detection circuit.

Figure 10:
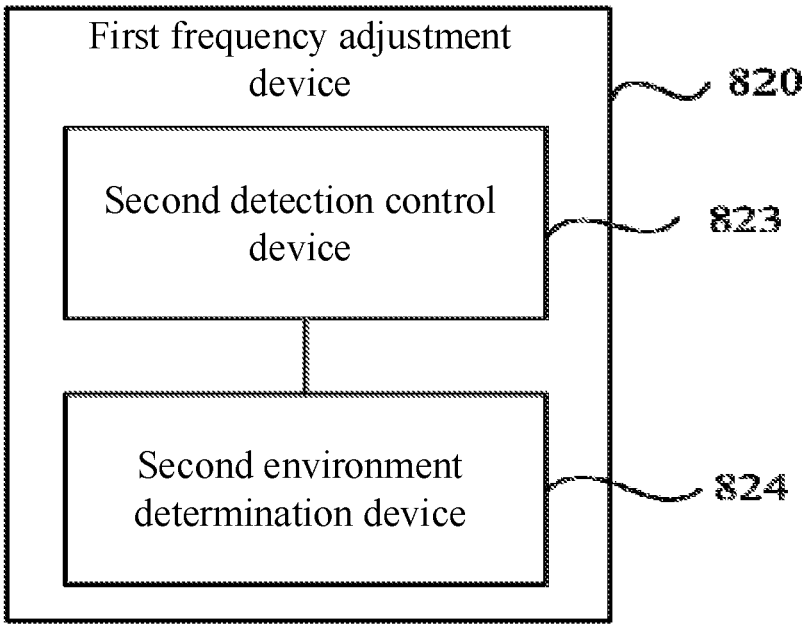
FIG. 10 is a structural diagram of another first frequency adjustment device according to an embodiment of the present disclosure.

Correspondingly, FIG. 10 is a structural diagram of another first frequency adjustment device according to an embodiment of the present disclosure. As shown in FIG. 10, the first frequency device 820 may include a second detection control device 823 and a second environment determination device 824.

The second detection control device 823 is configured to control the current detection circuit to detect the current signal output by the reference voltage signal terminal.

The second environment determination device 824 is configured to: in response to determining that a difference between the current signal and the maximum value of the reference voltage range is greater than a second preset value, determine that the display device is in the strong light environment.

The reference voltage signal terminal is connected to the gate of the drive transistor of the pixel driver circuit in the display device.

What is claimed is:

1. A driving method of a display device, comprising:

in response to determining that the display device enters a low power consumption state, controlling a light intensity detection component to detect in real time whether the display device is in a strong light environment;

in a case where the display device is in the strong light environment, controlling a driver chip to adjust a picture refresh frequency to a first frequency; and in a case where the display device is not in the strong light environment, determining a current gray scale of the display device according to a latest instruction set by a user, determining an optimal refresh frequency according to the current gray scale and a corresponding relationship between a preset gray scale and the optimal refresh frequency, and controlling the driver chip to adjust the picture refresh frequency to the optimal refresh frequency;

wherein the first frequency and the optimal refresh frequency each are smaller than a picture refresh frequency of the display device in a normal display state.

2. The driving method according to claim 1, wherein determining that the display device enters a low power consumption state comprises:

in response to an accumulated no-process state lasting for a preset duration, determining that the display device enters a low power consumption state.

3. The driving method according to claim 1, wherein the light intensity detection component is an environment light sensor.

4. The driving method according to claim 3, wherein controlling a light intensity detection component to detect whether the display device is in a strong light environment comprises:

controlling the environment light sensor to detect luminance of environment light; and in response to determining that the luminance of the environment light is greater than a first preset value, determining that the display device is in the strong light environment.

5. The driving method according to claim 4, wherein the first preset value is 300 cd/m2.

6. The driving method according to claim 1, wherein the light intensity detection component is a current detection circuit.

7. The driving method according to claim 6, wherein controlling a light intensity detection component to detect whether the display device is in a strong light environment comprises:

controlling the current detection circuit to detect a current signal output by a reference voltage signal terminal; and in response to determining that the current signal is greater than a maximum value of a reference voltage range, determining that the display device is in the strong light environment;

wherein the reference voltage signal terminal is connected to a gate of a drive transistor of a pixel driver circuit in the display device.

8. The driving method according to claim 7, wherein the reference voltage range is 200 μA to 400 μA.

9. The driving method according to claim 1, wherein the first frequency is 20 Hz to 30 Hz.

10. The driving method according to claim 1, wherein the corresponding relationship between the preset gray scale and the optimal refresh frequency comprises:

an optimal refresh frequency corresponding to 0 gray scale is a second frequency;

an optimal refresh frequency corresponding to (128−a) gray scale to (128+b) gray scale is a third frequency; and an optimal refresh frequency corresponding to 1 gray scale to (127−a) gray scale and an optimal refresh frequency corresponding to (129+b) gray scale to 255 gray scale each are a fourth frequency;

wherein a and b each are positive integers, $1 \leq a \leq 63$, and $1 \leq b \leq 125$.

11. The driving method according to claim 10, wherein the second frequency is 1 Hz, the third frequency is 15 Hz and the fourth frequency is 20 Hz.

12. The driving method according to claim 10, comprising: turning off a power signal, while controlling the driver chip to adjust the picture refresh frequency to the second frequency.

13. The driving method according to claim 1, comprising: in response to determining that the display device enters the low power consumption state, controlling a power chip to stop supplying a power signal, and controlling the driver chip to start supplying a power signal.

14. The driving method according to claim 1, after controlling the driver chip to adjust the picture refresh frequency to the first frequency or controlling the driver chip to adjust the picture refresh frequency to the optimal refresh frequency, further comprising:

determining whether the display device enters the normal display state; and in a case where the display device enters the normal display state, controlling the driver chip to adjust the picture refresh frequency to a second frequency;

wherein the second frequency is the picture refresh frequency of the display device in the normal display state.

15. A driving device of a display device, comprising:

a strong light detection device, configured to: in response to determining that the display device enters a low power consumption state, control a light intensity detection component to detect in real time whether the display device is in a strong light environment;

a first frequency adjustment device, configured to: in response to the light intensity detection component determining that the display device is in the strong light environment, control a driver chip to adjust a picture refresh frequency to a first frequency; and a second frequency adjustment device, configured to: in response to the light intensity detection component determining that the display device is in a non-strong light environment, determine a current gray scale of the display device according to a latest instruction set by a user, determine an optimal refresh frequency according to the current gray scale and a corresponding relationship between a preset gray scale and the optimal refresh frequency, and control the driver chip to adjust the picture refresh frequency to the optimal refresh frequency;

wherein the first frequency and the optimal refresh frequency each are smaller than a picture refresh frequency of the display device in a normal display state.

16. The driving device according to claim 15, wherein the light intensity detection component is an environment light sensor; and the first frequency adjustment device comprises:

a first detection control device, configured to control the environment light sensor to detect luminance of environment light; and a first environment determination device, configured to: in response to determining that the luminance of the environment light is greater than a first preset value, determine that the display device is in the strong light environment.

17. The driving device according to claim 15, wherein the light intensity detection component is a current detection circuit; and the first frequency adjustment device comprises:

a second detection control device, configured to control the current detection circuit to detect a current signal output by a reference voltage signal terminal; and a second environment determination device, configured to: in response to determining that a difference between the current signal and a maximum value of a reference voltage range is greater than a second preset value, determine that the display device is in the strong light environment;

wherein the reference voltage signal terminal is connected to a gate of a drive transistor of a pixel driver circuit in the display device.

* * * * *